US006756962B1

(12) United States Patent
Akimoto et al.

(10) Patent No.: US 6,756,962 B1
(45) Date of Patent: Jun. 29, 2004

(54) IMAGE DISPLAY

(75) Inventors: Hajime Akimoto, Ome (JP); Yoshirou Mikami, Hitachiouta (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/149,061

(22) PCT Filed: Feb. 10, 2000

(86) PCT No.: PCT/JP00/00748

§ 371 (c)(1),
(2), (4) Date: Jun. 7, 2002

(87) PCT Pub. No.: WO01/59750

PCT Pub. Date: Aug. 16, 2001

(51) Int. Cl.[7] ..... G09G 3/36; G09G 5/00; G09G 5/10

(52) U.S. Cl. ..... 345/98; 345/87; 345/89; 345/98; 345/100; 345/690

(58) Field of Search ..... 345/87, 89, 90, 345/94, 98, 99, 100, 690, 212, 214, 204

(56) References Cited

U.S. PATENT DOCUMENTS

| | | | | |
|---|---|---|---|---|
| 5,489,910 A | * | 2/1996 | Kuwata et al. | 345/212 |
| 5,721,563 A | * | 2/1998 | Memida | 345/98 |
| 5,751,279 A | * | 5/1998 | Okumura | 345/212 |
| 5,760,757 A | * | 6/1998 | Tanaka et al. | 345/93 |
| 5,850,204 A | * | 12/1998 | Maekawa | 345/98 |
| 6,201,523 B1 | * | 3/2001 | Akiyama et al. | 345/96 |
| 6,331,844 B1 | * | 12/2001 | Okumura et al. | 345/87 |
| 6,567,066 B1 | * | 5/2003 | Hashimoto | 345/100 |

FOREIGN PATENT DOCUMENTS

| | | |
|---|---|---|
| EP | 0 899 712 | 3/1999 |
| EP | 0 899 714 | 3/1999 |
| JP | 3-167977 | 7/1991 |
| JP | 7-162788 | 6/1995 |
| JP | 8-335059 | 12/1996 |
| JP | 9-244590 | 9/1997 |
| JP | 10-301539 | 11/1998 |
| JP | 11-73163 | 3/1999 |
| JP | 11-73165 | 3/1999 |
| JP | 11-85017 | 3/1999 |

OTHER PUBLICATIONS

R. Hashido et al., "An Offset Cancel Circuit for Integrated Data–Driver composed of Low–Temperature poly–Si TFTs," IEICE Technical Report Electronic Information Displays 98–125, Jan. 1999, pp. 91–96.

* cited by examiner

*Primary Examiner*—Regina Liang
*Assistant Examiner*—Duc Q. Dinh
(74) *Attorney, Agent, or Firm*—Miles & Stockbridge P.C.

(57) ABSTRACT

A liquid crystal image display comprising differential amplifiers composed of polycrystalline Si TFTs incorporated in buffer for a signal line driver. The image display includes buffer outputting switches for turning off the outputs of the buffers and signal line shunting switches for shorting the input and output terminals of the buffer. For the first half of one horizontal period, the signal line shunting switches are held off whereas the buffer outputting switches are held on, to feed signal lines with an image signal voltage selected by level select switches through the buffers. For the second half of the horizontal period, the signal line shunting switches are held on whereas the buffer outputting switches are held off, to feed the signal lines directly with the image signal voltage selected by the level select switches, and the signal lines fed with the equal image signal voltages are shorted to prevent the brightness nonuniformity of vertical streaks, as might otherwise be caused because said buffers have different offset voltages.

22 Claims, 12 Drawing Sheets

IMAGE DISPLAY

TECHNICAL FIELD

The present invention relates to a liquid crystal image display that can display high quality images in particular.

BACKGROUND ART

A circuit diagram of an offset canceling buffer for a low-temperature poly-Si TFT panel drive circuit in a conventional liquid crystal image display is illustrated in FIG. 13. This circuit cancels the offset voltage of the output of a differential amplifier 115 that comprises the buffer. As a consequence, luminance non-uniformity of vertical streaks on a liquid crystal panel due to variations in the offset voltages of a plurality of buffers in the liquid crystal image display can be prevented. Variations in the offset voltages among the buffers are caused by a great variation in the device performance of low-temperature poly-Si TFTs that constitute positive and negative (inverted) inputs of the differential amplifier 115, as compared with single-crystal MOS transistors.

Referring to FIG. 13, an analog input signal input to an input terminal Vin is supplied to an image pixel area (not shown), in the form of an analog output from an output terminal Vout via the differential amplifier 115 being given a negative feedback. The offset canceling circuit comprises a capacitance 151, switches 152, 153, and 154, a negative feedback loop that passes through the switch 152 and the capacitance 151, and a wire that extends from a point between the switch 152 and the capacitance 151 to be connected to the input terminal Vin via the switch 154.

An operation associated with FIG. 13 will be described below. In the first half of a horizontal scanning period, the switches 153 and 154 are turned on, and the switch 152 is turned off. At this point, the offset voltage of the output of the differential amplifier 115 is stored in the capacitance 151. Then, in the second half of the horizontal scanning period, the switches 153 and 154 are turned off, and the switch 152 is turned on. Since the capacitance 151 that stores the offset voltage of the differential amplifier 115 is inserted in series into the negative feedback loop as a result of this operation, the offset voltage is subtracted within the differential amplifier 115. It means that the offset voltage is canceled.

This conventional art is described in detail in IEICE Technical Report Electronic Information Displays 98–125, January 1999, for example.

DISCLOSURE OF THE INVENTION

According to the conventional art described above, the offset voltage caused by a mismatch of the differential amplifier using polycrystalline Si TFTs can be canceled. However, if switches in the offset canceling circuit are composed of polycrystalline Si TFTs, the switch 153 causes a variation among the offset voltages of a plurality of offset canceling buffers in a liquid crystal image display.

This will be described below with reference to FIG. 14. FIG. 14 is a diagram where reference characters necessary for the description are added to the circuit diagram of the offset canceling buffer illustrated in FIG. 13. Cm denotes a capacitance value of the capacitance 151, Cp denotes a capacitance value of a parasitic capacitance 155 for a inverted input terminal of the differential amplifier 115, a node A denotes the inverted input terminal of the differential amplifier 115, q1 and q2 denote feed-through charges resulting from turning off of the switch 153, and G denotes the open-loop gain of the differential amplifier 115.

In the offset canceling operation, after storing the offset voltage of the differential amplifier 115 in the capacitance 151, when turning off the switches 153 and 154, the TFTs that comprise the respective switches emit feed-through charges to their respective source and drain terminals. As a result of this, the feed-through charge q1 modulates the amount of charges stored in the node A. This modulation occurs irrespective of an order in which the switches 153 and 154 are turned off. The feed-through charge q2 of the switch 153 has no appreciable effect on the modulation. Incidentally, the modulation of the amount of charges stored in the node A by the feed-through charge of the switch 154 can be avoided by turning off a head of the switch 153.

The modulation of the amount of charges stored in the node A causes an additional offset voltage Δ Vout expressed by Equation (1) to the output terminal Vout of the offset canceling buffer.

$$\Delta Vout = -G/(G \cdot Cm + Cp + Cm) \cdot q1 \qquad \text{Equation (1)}$$

Generally, the open-loop gain G of the differential amplifier 115 is designed to be an exceedingly large value. However, even if the open loop gain G is approximated as an infinite value, the offset voltage Δ Vout of (−q1/Cm) is generated, as determined by Equation (1).

Then, this offset voltage Δ Vout varies among a plurality of offset canceling buffers in the liquid crystal image display according to the following reason.

Since the buffer is provided for an impedance reduction, it is not preferable that input impedance is designed to be small, so that the capacitance Cm of the capacitance 151 cannot be designed to be so large. Consequently, the influence of the switch feed-through charge q1 generated when the switch 153 is turned off will become great.

When a single-crystalline MOS transistor is employed as a switch, a variation in a threshold voltage Vth of the switch is in general at most approximately 20 mV, and the gate dimensions are of the order of submicrons. However, in the case of a polycrystalline Si TFT, its channel comprises a crystalline grain structure, and a surface of a gate insulation film is not stabilized, so that the Vth sometimes ranges from several hundred millivolts to nearly one volt at most. In addition, since the dimensions of a substrate of the low-temperature poly-Si TFT is comparatively large, ranging from several ten centimeters to one meter, the dimensions of the processed gate are of the order of at least several microns. Accordingly, variations of processing are comparatively large.

The feed-through charge q1 mainly comes from a channel charge Cg·(Vg−Vth), in which Cg denotes a gate capacity determined by the area of the gate, the thickness of the gate insulation film, and the dielectric constant of the gate insulation film. Accordingly, variations of the Vth and the area of the gate affect the variation of the feed-through charge q1, and as a result make variations of the offset voltages Δ Vout among the offset canceling buffers.

Assuming a variation of the threshold voltage Vth is 1V, Cm is 100 times of the channel capacity of the switch 153, and q1 is a half of the channel charge of the switch 153, for example, a variation of the offset voltage Δ Vout is larger than 5 mV at the outputs of the offset canceling buffer, even if the open-loop gain G of the differential amplifier is assumed to be infinite. Further, a variation of the area of the gate is added to the above-mentioned variation, so that a variation in the offset voltage Δ Vout becomes larger than 5 mV. Thus, this offset canceling circuit is impractical.

Incidentally, here, a problem existing in the conventional offset canceling circuit is explained, as a problem caused by the switch 153. This is not a specific problem for the circuit illustrated in FIG. 14, but is a common problem for offset canceling circuits in general. In the offset canceling circuit, an offset voltage stored in a capacitance in advance is added to an input to the differential amplifier for subtracting it. For this purpose, it is necessary that one end of the capacitance is connected to the input terminal of the differential amplifier. Further, to write the offset voltage in the capacitance, the above-mentioned end of the capacitance must be connected to a switch simultaneously. So that, theoretically, a feed-through charge at the time of this switch being turned off is applied to the input of the differential amplifier through the capacitance as a voltage. Even if the switch is composed of an n-type TFT, a p-type TFT, or a CMOS TFT, the same problem occurs in view of variations of the feed-through charges.

An object of the present invention is to prevent variations of the offset voltages of buffers (impedance reduction means) that comprise differential amplifiers regardless of whether an offset canceling circuit is present therein or not.

The above-mentioned object can be achieved by an image display that comprises:

- liquid crystal capacitances, and a plurality of display pixels being arranged in a matrix and having pixel switches connected to one electrode of the liquid crystal capacitances;
- image signal voltage generating means for generating first analog image signal voltages based on image display data;
- a plurality of impedance reducing means receiving the first analog image signal voltages and then outputting second analog image signal voltages, being configured by polycrystalline Si thin-film transistors and having differential amplifiers;
- a plurality of signal lines connected to output terminals of the impedance reducing means and the pixel switches;
- signal voltage write means for writing the second analog image signal voltages in predetermined liquid crystal capacitances through the signal lines and the pixel switches;
- first switching means for switching the impedance reducing means to substantially infinite output impedance at a first timing; and
- second switching means for interconnecting signal lines to which the second analog image signal voltages based on mutually identical said image display data are supplied, at a second timing following the first timing.

BEST MODE FOR CARRYING OUT THE INVENTION

First Embodiment

Figure 1:
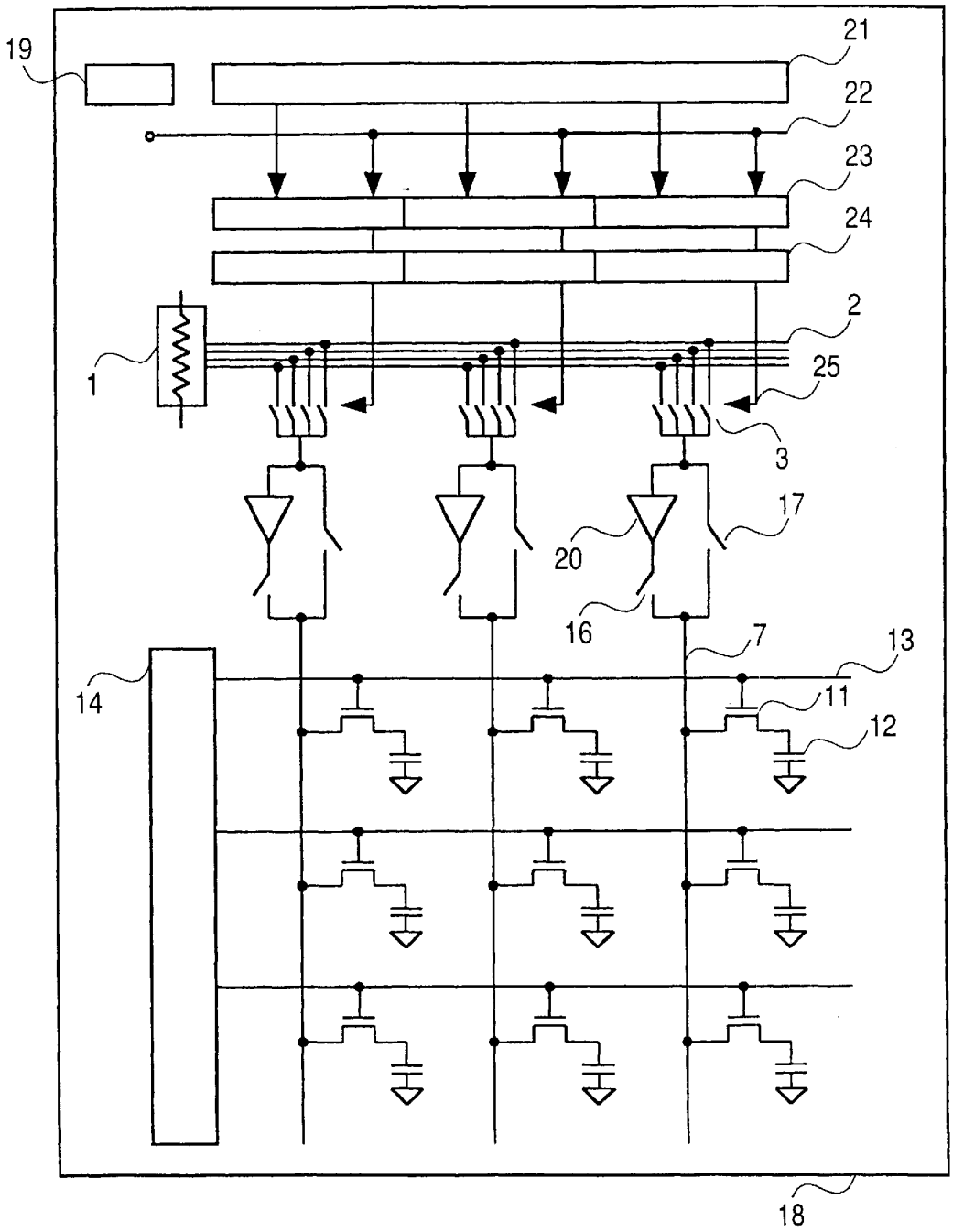
FIG. 1 is a block diagram showing a polycrystalline Si liquid crystal display panel according to a first embodiment.

A polycrystalline Si liquid crystal display panel according to a first embodiment of the present invention will be described with reference to FIGS. 1 to 4. FIG. 1 is a block diagram showing a polycrystalline Si liquid crystal display panel. A display pixel comprising a liquid crystal capacitance 12 formed between opposing liquid crystal electrodes being applied a predetermined voltage and a pixel TFT 11 connected to it is arranged in a matrix and constitutes an image display area. The gate of the TFT 11 is connected to a gate-line drive circuit 14 through a gate-line 13, and the other end of the pixel TFT 11 is connected to an offset canceling buffer outputting switch 16 and a signal line shunting switch 17 through a signal line 7. CMOS switches that employ polycrystalline Si TFTs are employed as switches here. The offset canceling buffer outputting switch 16 is connected to the output terminal of an offset canceling buffer 20. The input terminal of the offset canceling buffer 20 is coupled to the other terminal of the signal line shunting switch 17 to be connected to level select switches 3. The gates of the level select switches 3 are selectively controlled by level select lines 25, and the other ends of the switches are connected to gradation power lines 2. The level select switches 3 thereby functions as a whole, as decoders that operates as D/A converters. Image display data herein is composed of 6 bits, so that the gradation power lines 2 comprise 64 parallel wires to which different gradation voltages are applied, and the gradation power lines 2 are connected to a gradation voltage generating circuit 1. The gradation power lines 2 almost cross over a glass substrate 18 in a lateral direction, and are longer than the width of the image display area comprised of display pixels. The level select lines 25, on the other hand, are supplied from a primary latch circuit 23 through a secondary latch circuit 24. The outputs of a digital data input line 22 and a latch address selection circuit 21 are supplied to the primary latch circuit 23. These circuits, as a whole, are controlled by a timing pulse generation circuit 19. Further, respective circuit blocks are formed on the glass substrate 18, using polycrystalline Si TFT devices.

Next, an operation of the liquid crystal display panel will be outlined. Image display data supplied to the digital data input line 22 is latched by the primary latch circuit 23 having an address selected by the latch address selection circuit 21. Upon completion of latch of image display data necessary for writing a single line within one horizontal scanning period, these image display data are transferred from the primary latch circuit 23 to the secondary latch circuit 24 one after another, and the secondary latch circuit 24 supplies the image display data to the level select lines 25. The level select switches 3 that comprise decode switches supply predetermined analog image signal voltages to the offset canceling buffers 20 and the signal line shunting switches 17 from the gradation power lines 2 according to the contents of the level select lines 25.

In the first half of one horizontal scanning period, the signal line shunting switches 17 are held off, while the offset canceling buffer outputting switches 16 are held on. During this period, the offset canceling buffers 20 supply image signal voltages basically corresponding to the supplied image signal voltages to the signal lines 7 through the offset canceling buffer outputting switches 16 to the signal lines 7. The buffer operates as means for reducing impedance. Thus, the output impedances of the level select switches 3 when the offset canceling buffers 20 are provided become lower than the output impedances of the level select switches 3 when the offset canceling buffers 20 are not present, so that cross-talk between the signal lines 7 due to the influence of the input impedances of the signal lines 7 can be prevented.

Next, in the second half of one horizontal scanning period, the signal shunt switches 17 are held on, while the offset canceling buffer outputting switches 16 are held off. During this period, image signal voltages are directly supplied to the signal lines 7 through the level select switches 3, and the signal lines 7 to which image signal voltages based on identical image display data are supplied through the level select switches 3 and the gradation power lines 2 are short-circuited. Consequently, variations in the offset voltages arising from the feed-through charges, contained in the outputs of the offset canceling buffers 20 disappear.

As the above-mentioned manner, the image signal voltages free of the variations of the offset voltages being supplied to the signal lines 7 are written into the corresponding liquid crystal capacitances 12, by turning off pixel TFTs for a predetermined line by means of the gate-line drive circuit 14 through the gate-line 13.

Circuit Configuration of the Offset Canceling Buffers 20.

Figure 2:
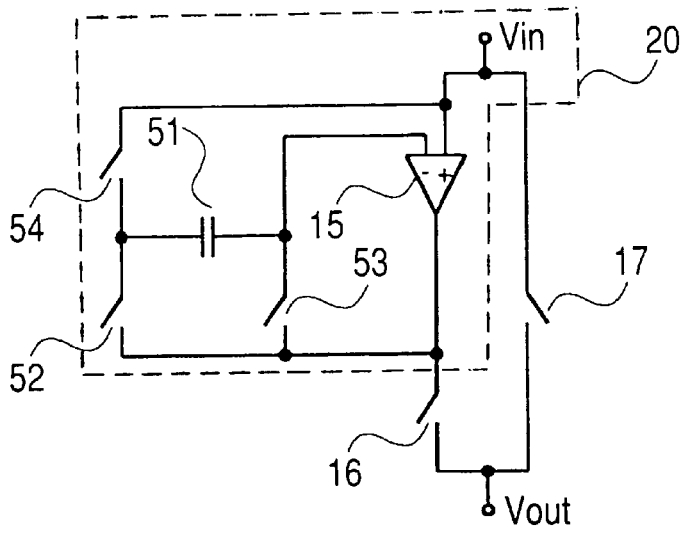
FIG. 2 is a circuit diagram in which an offset canceling buffer outputting switch 16 and a signal line shunting switch are connected to an offset canceling buffer in the polycrystalline Si liquid crystal display panel according to the first embodiment.

A circuit configuration of each offset canceling buffer 20, a circuit configuration of a differential amplifier 15, and an operation of an offset canceling circuit will be described below. FIG. 2 is a circuit diagram in which each offset canceling buffer outputting switch 16 and each signal line shunting switch 17 are connected to the offset canceling buffer 20. The offset canceling buffer 20 comprises the differential amplifier 15 and the offset canceling circuit. In the offset canceling circuit, one end of an offset canceling capacitance 51 is connected to the inverted input terminal of the differential amplifier 15 and to the output terminal of the differential amplifier 15 through a switch 53. The other end of the offset canceling capacitance 51 is connected to the positive input terminal of the differential amplifier 15 through a switch 54 and to the output terminal of the differential amplifier 15 through a switch 52.

Figure 3:
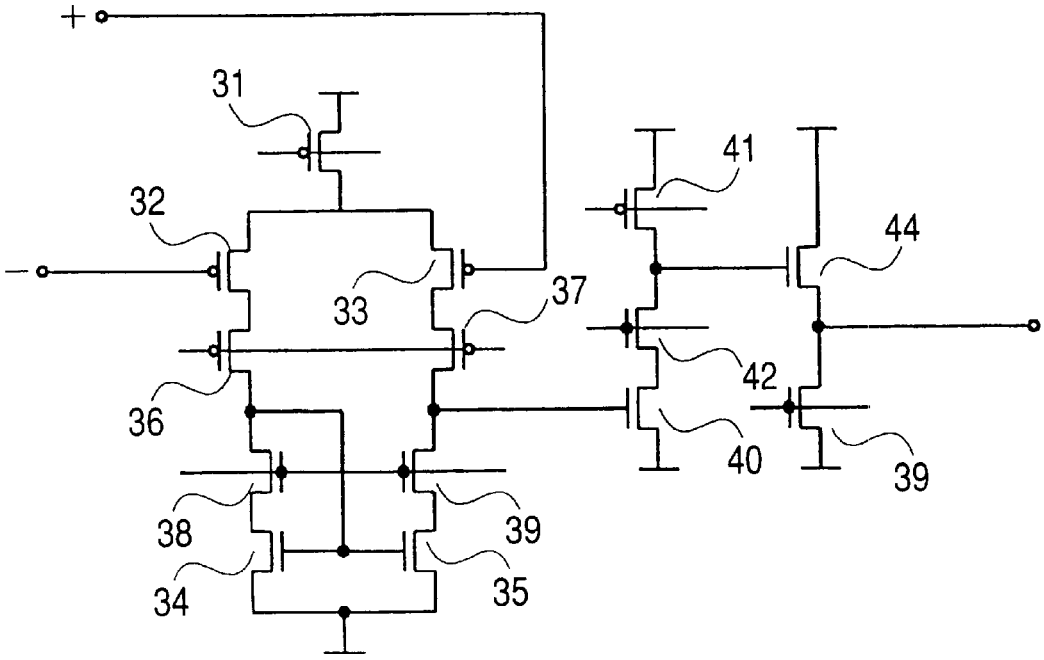
FIG. 3 is a circuit diagram of a differential amplifier in the polycrystalline Si liquid crystal display according to the first embodiment.

FIG. 3 is a circuit diagram of the differential amplifier 15. A differential stage basically comprises a driver section that includes p-type polycrystalline Si TFTs 32 and 33, a load section that comprises n-type polycrystalline Si TFTs 34 and 35, and a current source that includes a p-type polycrystalline Si TFT 31. p-type polycrystalline Si TFTs 36 and 37, n-type polycrystalline Si 38 and 39 are added to make this circuit to have a cascode structure. Although TFTs have not a substrate bias effect, they have a problem that a drain-conductance is large. Thus, in order to sufficiently ensure the differential amplifier gain of the order of several hundred times, the above-mentioned cascode structure becomes necessary. In the stage subsequent to the differential stage, an amplification stage having the cascode structure is provided for the same reason. In this stage, an n-type polycrystalline Si 40 serves as a driver, a p-type polycrystalline Si TFT 41 serves as a load, while an n-type polycrystalline Si 42 serves as a device for cascode connection. In the final stage, a source follower stage is provided for reducing output impedance. n-type polycrystalline Si TFTs 44 and 45 serve as a driver transistor and a load transistor, respectively. By adopting the above-mentioned configuration, the differential amplifier 15 can provide both a sufficiently large voltage gain and a sufficiently low output impedance though the differential amplifier 15 is composed of polycrystalline Si TFTs.

Figure 4:
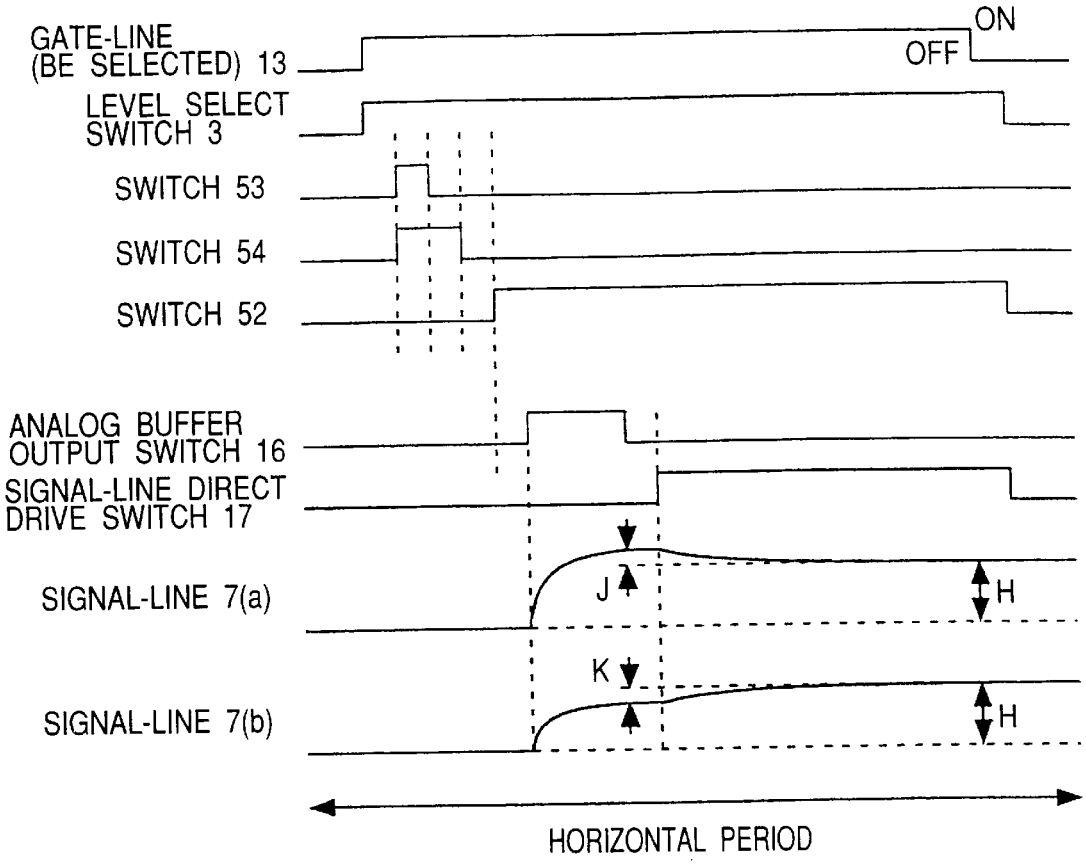
FIG. 4 is a timing chart of operating pulses during one horizontal period in the polycrystalline Si liquid crystal display panel according to the first embodiment.

FIG. 4 is a timing chart of operating pulses during one horizontal period according to this embodiment. In this chart, the on/off state of a switch is indicated by an upper line portion and a lower line portion, respectively, as indicated in the diagram as well.

At the beginning of a horizontal period, the gate-line 13 selected by the gate-line drive circuit 14 and level select switches 3 are turned on. Then, the operations of the offset canceling circuits in the offset canceling buffers 20 are started to turn the switches 53 and 54 on. The offset voltages of the differential amplifiers 15 are thereby stored in the offset canceling capacitances 51. Thereafter, the switches 53 and 54 are turned off in this stated order. As described before, the order in which these switches are turned off is important for eliminating the influence of the feed-through charges of the switches 54. Then, the switches 52 are turned on. The offset voltages of the differential amplifiers 15 stored in the offset canceling capacitances 51 are thereby supplied to negative feedback loops. The offset voltages resulting from a TFT mismatch in the differential amplifiers 15 that employ polycrystalline Si TFTs are then canceled. When the offset canceling buffer outputting switches 16 are turned on in this state, image signal voltages are supplied from the offset canceling buffers 20 to the signal lines 7.

At this point, however, as already described, variations in the feed-through charges of the switches 53 connected to the inputs of the differential amplifiers 15 are still present in the form of variations in the offset voltages. Herein, in order to explain about disappearance of variations in the offset voltages, two signal lines 7(*a*) and 7(*b*) will be picked up as the signal lines to which image signal voltages based on the identical image display data are supplied. Referring to FIG. 4, as a difference from H is indicated by reference characters J and K, generally, output voltages of the signal lines differ. Thereafter, in the second half period where analog image signal voltages are supplied to the signal lines 7, after the offset canceling buffer outputting switches 16 are turned off, the signal line shunting switches 17 are turned on. At this point, image signal voltage outputs that have passed through the level select switches 3 are directly supplied to the signal lines 7(*a*) and 7(*b*). Thus, variations in the offset voltages contained in the outputs of the offset canceling buffers 20 disappear, so that the outputs of the signal lines 7(*a*) and 7(*b*) become the same value (herein indicated by H).

Thereafter, after the gate-line 13 is turned off, the level select switches 3, switches 52, and signal shunt switches 17 are turned off one after another. Write operations during one horizontal period are thereby completed, so that image signal voltages free of the variations in the offset voltages are written in the liquid crystal capacitances 12.

With this arrangement, in this embodiment, it is possible to eliminate variations in the offset voltages resulting from variations in the feed-through charges of the switches connected to the inputs of the differential amplifiers. No luminance non-uniformity of vertical leaks appears on the polycrystalline Si liquid crystal display panel develops.

Incidentally, during this period, the electrical charges supplied to the signal lines 7 through the signal line shunting switches 17 are far smaller than the electrical charges supplied to the signal lines 7 through the offset canceling buffer outputting switches 16. Thus, in order to reduce a layout area, it is preferable that the channel width of a polycrystalline Si TFT-CMOS transistor that comprises each signal line shunting switch 17 is designed to be smaller than the channel width of a polycrystalline Si TFT-CMOS transistor that comprises each offset canceling buffer outputting switch 16 to make the on-resistance of the former switch to be larger than the on-resistance of the latter switch. Further, in order to reduce the on-resistance of the former switch, it is effective to make the channel length of the transistor of each signal line shunting switch 17 to be shorter than the channel length of the transistor of each offset canceling buffer outputting switch 16.

In this embodiment, circuit blocks are constructed on the glass substrate 18, using polycrystalline Si TFT devices. Formation of part of the blocks of circuits such as the timing pulse generation circuit 19 and the gradation voltage generating circuit 1 by employing single crystalline Si LSIs is also possible. It is also possible to employ a quartz substrate or a transparent plastic substrate instead of the glass substrate. Alternatively, it is also possible to change the method of displaying liquid crystals to a reflective type, thereby employing an opaque substrate such as a Si substrate.

Further, the differential amplifier can also be configured by reversing the order of n and p conductive types of the TFTs, or by employing other circuit configuration within the scope of the present invention. For simplifying the description, the image display data is composed of 6 bits, and the number of the parallel gradation power lines to which different gradation voltages are applied, is 64. If the image display data is composed of n bits, it is clear that the number of the parallel gradation power lines to which different gradation voltages are applied becomes $2^n$. Further, it is clear that the number of the parallel gradation power lines becomes twice of $2^n$ in consideration of reverse-voltage driving.

Further, in this embodiment, although CMOS switches are employed as the switches and n-type TFT switches are employed for the pixel TFTs, any switches can be used for the present invention. Various layouts including the one for a display pixel structure can be employed within the scope of the present invention.

Figure 15:
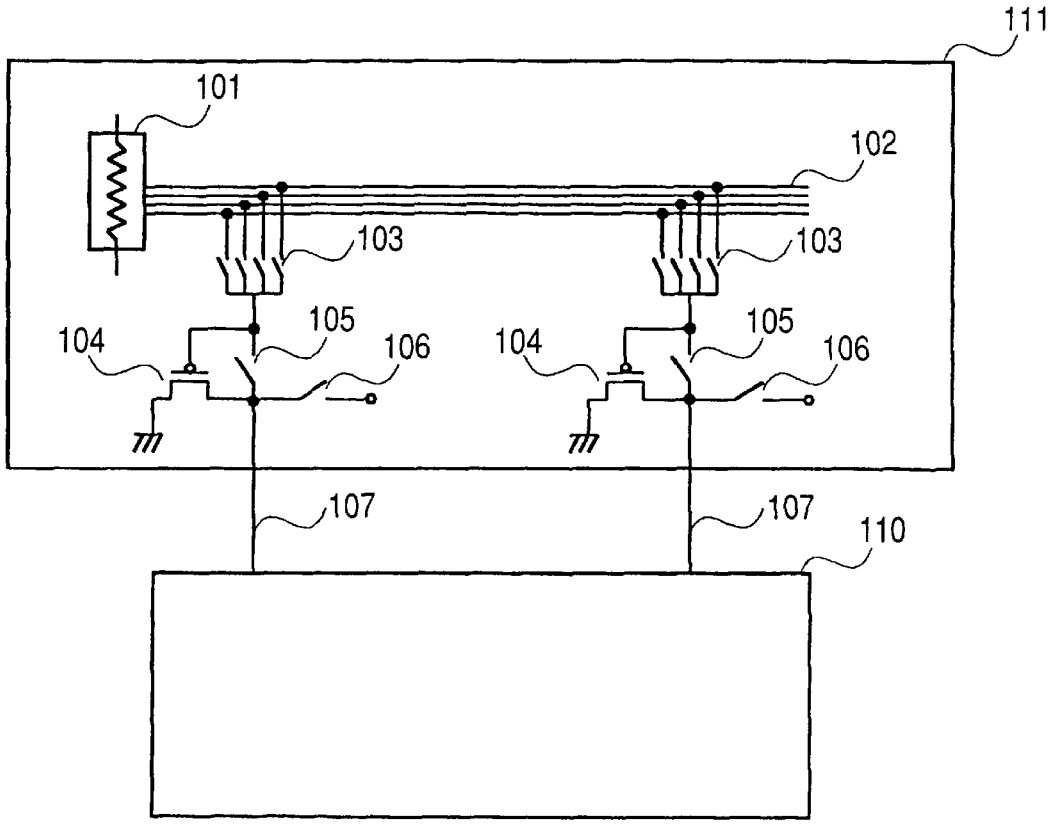
FIG. 15 is a diagram showing connection between an amorphous Si TFT liquid crystal panel and a driver LSI in JP-A-10-301539.

Next, as a result of investigation of well-known arts, JP-A-10-301539, which resembles the present invention and will be referred to as a prior art, was detected. Thus, a difference from the present invention will be described. FIG. 15 is a circuit diagram showing connection between an amorphous Si TFT liquid crystal panel 110 and a driver LSI 111 of the prior art.

Referring to FIG. 15, a plurality of reference voltages generated by a multi-level voltage generation circuit 101 are supplied to a plurality of reference voltage lines 102, and a plurality of voltage selection switches 103 are connected in parallel to the respective reference voltage lines 102. The output of a voltage selection switch 103 is supplied to a p MOS transistor 104 of a source follower connection and a signal-line drive switch 105. The source terminal of the p MOS transistor 104 and the other end of the signal-line drive switch 105 are connected to a signal line 107 and a pre-charge switch 106. The whole components are formed on a silicon substrate 111. The signal line 107 is coupled to the signal line 107 within an amorphous Si TFT liquid crystal panel 110.

Next, the operation of the prior art will be described. The multi-level voltage generation circuit 101 supplies different reference voltages to the reference voltage lines 102, and the voltage selection switch 103 selects a predetermined reference voltage according to an input digital image signal, thereby operates as an A/D converter. The pre-charge switches 106 are turned on during the initial period of one horizontal period to pre-charge the signal lines 107. Thereafter, the pre-charge switches are turned off. The p MOS transistors 104 connected as source follower charges a signal lines to voltages [(signal voltage supplied to the gates)−Vth]. However, for writing to the (signal voltages supplied to the gates), the voltages Vth are short. Therefore, by turning the signal-line drive switches 105 on in the second half of one horizontal period, the voltages corresponding to Vth are additionally written onto the signal lines 107 from the reference voltage lines 102.

With this arrangement, the prior art has a buffering effect of the p MOS transistor of the source follower connection, and the effects of low power dissipation due to absence of a current that passes through a buffer and eliminating a variation in the voltages Vth resulting from turning on the signal-line drive switches 105.

On the other hand, in the present invention, the output of the buffer amplifier is basically equal to a final image signal voltage, to which just a voltage variation is added. Therefore, the signal line shunting switch according to the present invention operates to average signal line voltages that should originally be identical, not to perform additional writing to the signal lines.

As described above, the prior art is similar to the present invention in that the output side and the input side of the p MOS transistor 104 of source follower connection are shunted or short-circuited by the signal-line drive switch 105. However, it can be seen that the well-known art and the present invention are based on completely different concepts.

The difference between the concepts accounts for the following two specific differences in construction.

First, in regard to the construction of the buffer, a single source follower transistor in the prior art is turned off at a gate voltage that has exceeded the value [(signal voltage supplied to the gate)−Vth]. Thus, the source follower transistor does not operate as impedance reducing means for the (signal voltage supplied to the gate) basically required as a write voltage. In the present invention, on the other hand, the buffer that also serves as the impedance reducing means for (signal voltage supplied to the gate) as well.

Second, the single source follower transistor automatically cuts off the output impedance of the source follower transistor. On contrast therewith, in the present invention, first switching means for switching the impedance reducing means to substantially infinite output impedance is provided.

The differences between the two can also be understand from the fact that the prior art is difficult to use as a driver for the polycrystalline Si TFT liquid crystal panel according to the present invention. The prior art is based on the assumption that additional writing is performed by turning on the signal-line drive switches 105. This art can be practiced by the short length of the reference voltage lines 102. In other words, even if the prior art is originally intended for use as the driver LSI, and the reference voltage lines 102 are provided across the whole length of the chip of the driver LSI chip, the length has the size of the chip and short, being less than 20 mm. On the other hand, in the case of the polycrystalline Si TFT liquid crystal panel according to the present invention, one of the original main purposes is to reduce the number of terminals to be connected to the outside. Generally, the gradation power lines that are herein defined extend to both of the ends of the panel. The length of the gradation power lines extended sometimes measure up to 20 cm or longer. In this case, the gradation power lines have a resistance as high as several kiloohms, so that additional writing to a signal line through a gradation voltage line is almost impossible in view of the time constant, or due to a fall in the voltage of the gradation voltage line.

Second Embodiment

Figure 5:
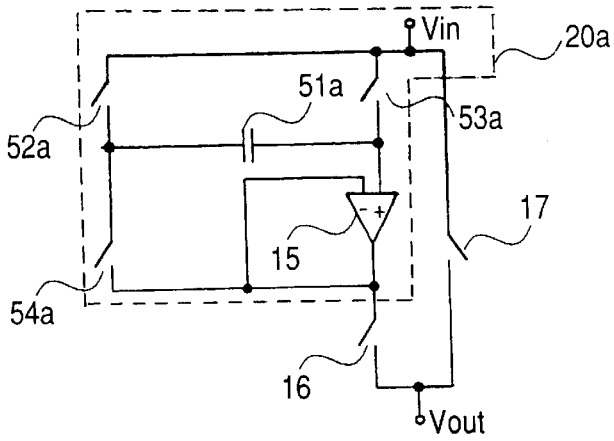
FIG. 5 is a circuit diagram in which the offset canceling buffer outputting switch and the signal line shunting switch 17 are connected to an offset canceling buffer in a polycrystalline Si liquid crystal display panel according to a second embodiment.

A polycrystalline Si liquid crystal display panel according to a second embodiment of the present invention will be described. A difference from the first embodiment of the present invention will be described below with reference to an offset canceling buffer. FIG. 5 is a circuit diagram in which the offset canceling buffer outputting switch 16 and the signal line shunting switch 17 are connected to an offset canceling buffer 20*a*.

The offset canceling buffer 20*a* comprises the differential amplifier 15 and an offset canceling circuit. In the offset canceling circuit, one end of an offset canceling capacitance 51*a* is connected to the positive input terminal of the differential amplifier 15 and connected to the input terminal Vin of the offset canceling buffer 20*a* through a switch 53*a*. The other end of the offset canceling capacitance 51*a* is connected to the output terminal of the differential amplifier 15 through a switch 54*a* and the input terminal Vin of the offset canceling buffer 20*a* through a switch 52*a*. The output terminal of the differential amplifier 15 is connected to its inverted input terminal to form a feedback loop.

In the first embodiment, an offset voltage resulting from a TFT mismatch in the differential amplifier 15 is canceled by insertion of the offset canceling capacitance 51 where the offset voltage is stored in series into the negative feedback loop. In this embodiment, on the other hand, the offset capacitance 51*a* where an offset voltage is stored is inserted for connection to the input terminal Vin of the offset canceling buffer 20*a* in series to apply an the offset voltage of the opposite polarity to the positive input terminal of the differential amplifier 15. The offset voltage is thereby canceled.

Since the operation timings of the respective switches in this embodiment are the same as those according to the first embodiment except that reference numerals 52, 53, and 54 for the switches in FIG. 4 are changed to 52*a*, 53*a*, and 54*a*, respectively, they are omitted.

In this embodiment as well, output voltage offset variations after the offset canceling operations, resulting from variations in the feed-through charges of the switches 53*a* connected to the inputs of the differential amplifiers 15 are eliminated by the operation of the signal line shunting switches 17.

In this embodiment, due to the influence of the parasitic capacitances Cp for the inverted input terminals of the differential amplifiers as well, the output voltage offset variations after the offset canceling operations tend to become higher than in the first embodiment. However, in the present invention, offset voltage variations disappear in any of the embodiments, so that this is not significant.

The advantage of this embodiment is that, since no switches are inserted into the negative feedback loop for the differential amplifier 15, the differential amplifier 15 resists being influenced by noise caused by the switches, so that the more stable noise characteristic is obtained.

Third Embodiment

Figure 6:
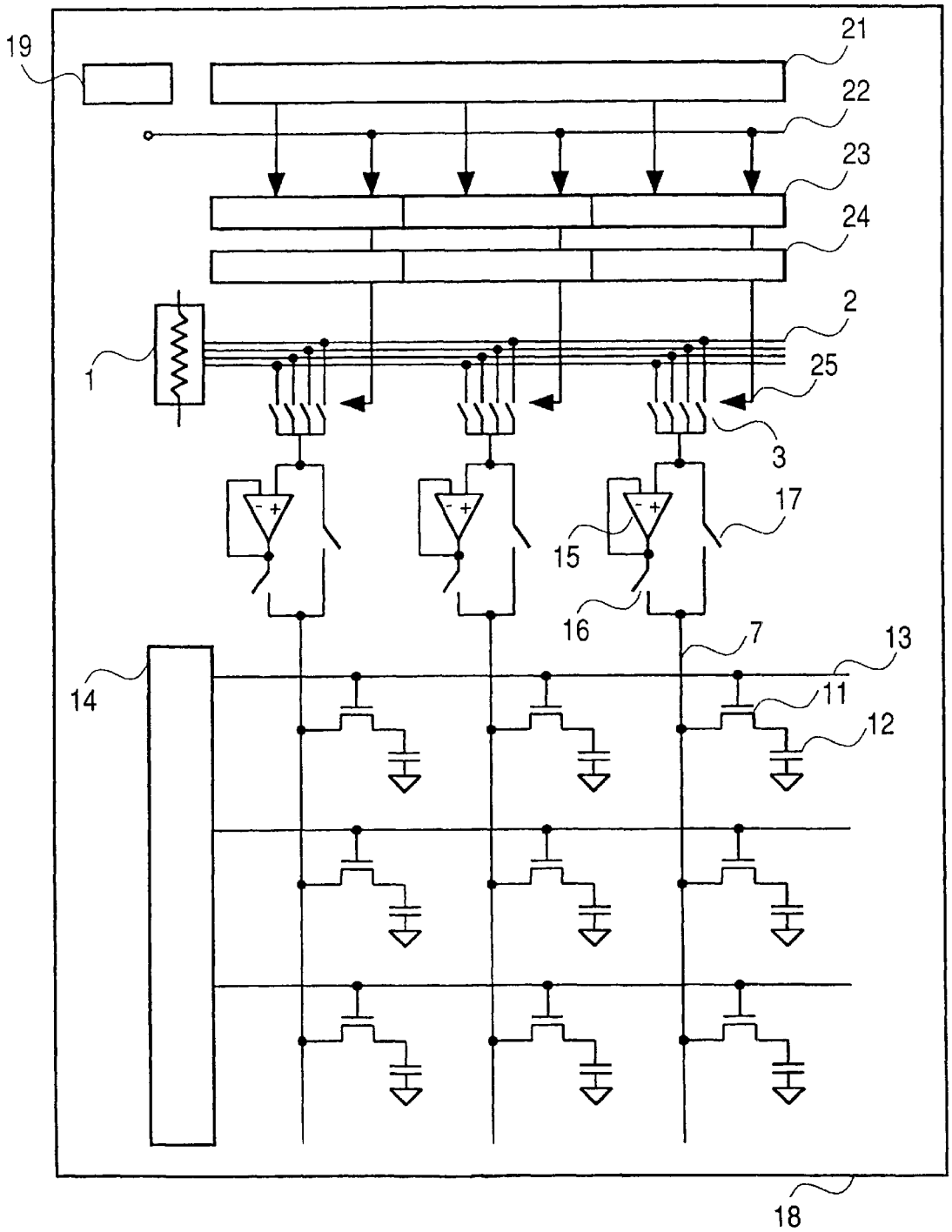
FIG. 6 is a block diagram showing a polycrystalline liquid crystal display panel according to a third embodiment.

A polycrystalline Si liquid crystal display panel according to a third embodiment of the present invention will be described with reference to FIGS. 6 and 7. FIG. 6 is a block diagram showing a polycrystalline Si liquid crystal display panel. This embodiment is characterized in that a buffer that comprises the differential amplifier 15 having a negative feedback loop without an offset canceling circuit is employed in place of the offset canceling buffer 20 according to the first embodiment. The structure of the differential amplifier 15 is the same as that described in the first embodiment with reference to FIG. 3.

Figure 7:
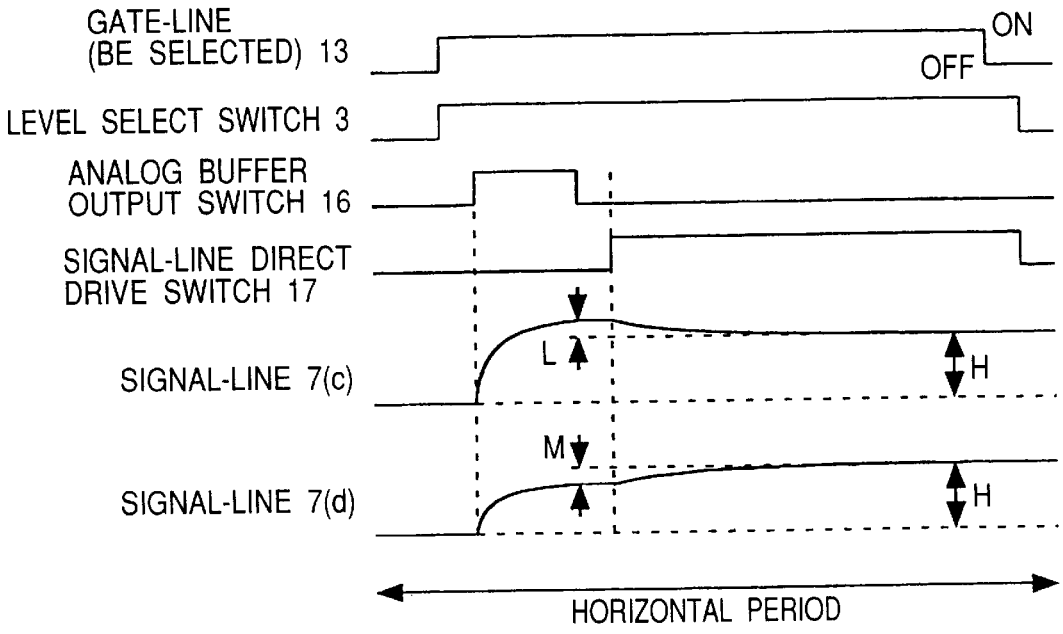
FIG. 7 is a timing chart of operating pulses during one horizontal period in the polycrystalline Si liquid crystal display panel according to the third embodiment.

FIG. 7 shows a timing chart of operating pulses during one horizontal period according to this embodiment. In this chart, turning on and off of switches are indicated by an upper line portion and a lower line portion, respectively. At the beginning of the one horizontal period, the gate-line 13 selected by the gate-line drive circuit 14 and the level select switches 3 are turned on. Then, when the offset canceling buffer outputting switches 16 are turned on, image signal voltages are supplied onto the signal lines 7 from the differential amplifiers 15.

At this point, variations in the offset voltages of the outputs of the differential amplifiers 15 are present. Herein, two signal lines to which the image signal voltages based on the identical image display data are supplied will be picked up, and denoted by 7(*c*) and 7(*d*), respectively. The offset voltages appear as shifts in output voltages, as indicated by L in 7(*c*), M in FIG. 7(*d*), respectively. L is not equal to M, thus variations are present.

Thereafter, in the second half period of the outputs of analog image signal voltages to the signal lines 7, after the offset canceling buffer outputting switches 16 are turned off, the signal line shunting switches 17 are turned on. At this point, since image signal voltage outputs are directly supplied onto the signal lines 7(*c*) and 7(*d*) through the level select switches 3, the output voltages are averaged. Consequently, the variations in the offset voltages contained in the outputs of the differential amplifiers 15 disappear, so that both of the outputs of the signal lines 7(*c*) and 7(*d*) go H.

Thereafter, after the gate-line 13 is turned off, the level select switches 3, signal line shunt switches 17 are turned off one after another. Write operations during one horizontal period are thereby completed, so that the image signal voltages free of the variations in the offset voltages are written into the liquid crystal capacitances 12.

As in this embodiment, even if no offset canceling circuit is provided, it is possible to eliminate variations in the offset voltages between the differential amplifiers. Luminance non-uniformity of vertical streaks can be thereby avoided on the polycrystalline Si liquid crystal display panel.

Fourth Embodiment

Figure 8:
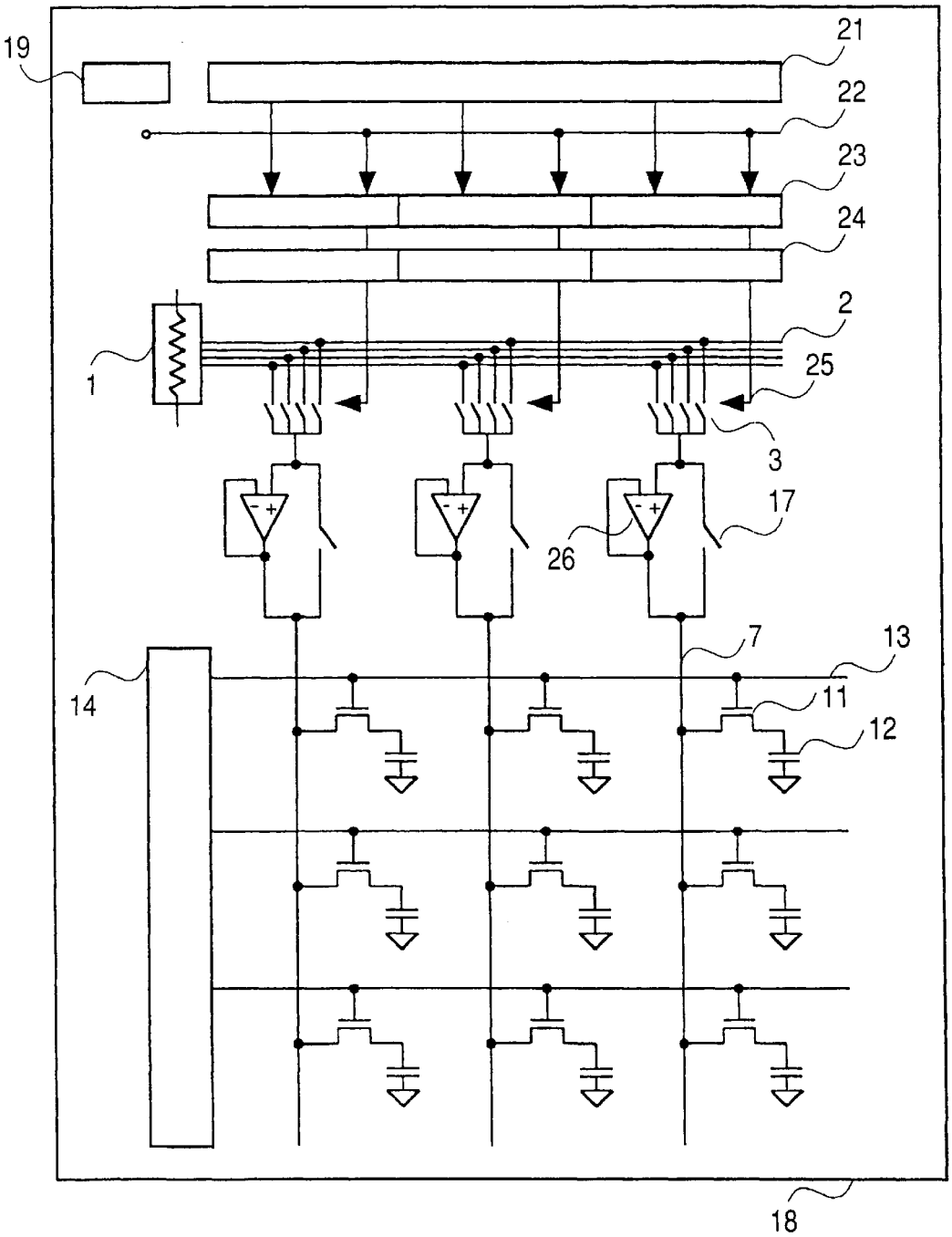
FIG. 8 is a block diagram showing a polycrystalline liquid crystal display panel according to a fourth embodiment.
Figure 9:
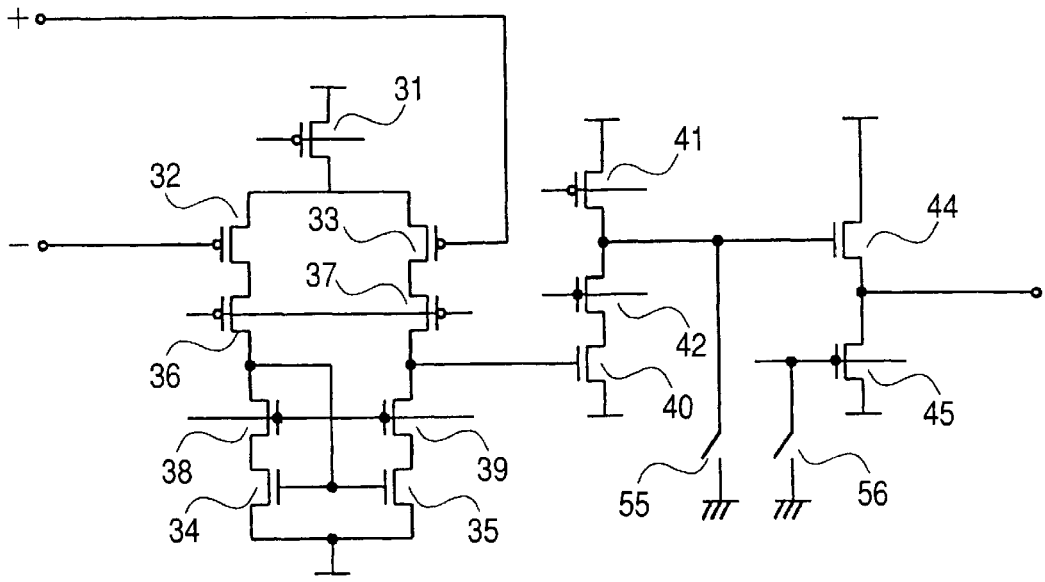
FIG. 9 is a circuit diagram of a differential amplifier in the polycrystalline liquid crystal display panel according to the fourth embodiment.

A polycrystalline Si liquid crystal display panel according to a fourth embodiment of the present invention will be described with reference to FIGS. 8 and 9. FIG. 8 is a diagram showing a configuration of the polycrystalline Si liquid crystal display panel. The structure and the operation of the panel are the same as those according to the third embodiment, except that no offset canceling buffer outputting switch 16 is present and that the circuit configuration of a differential amplifier 26 is changed.

In this embodiment, the function of the offset canceling buffer outputting switch 16 is integrated into the differential amplifier 26. FIG. 9 shows a circuit diagram of the differential amplifier 26. A differential stage comprises a driver section including the p-type polycrystalline Si TFTs 32 and 33, a load section including the n-type polycrystalline Si TFTs 34 and 35, and a current source including the p-type polycrystalline Si TFT 31. The p-type polycrystalline Si TFTs 36 and 37, and the n-type polycrystalline Si 38 and 39 are added to make this circuit to have a cascode structure. Although TFTs have the advantage of not having the substrate bias effect, their drain-conductance is large. Thus, in order to ensure the differential amplifier gain of the order of several hundred times, the above-mentioned cascode structure becomes necessary. In the stage subsequent to the differential stage, an amplification stage having a cascode structure is provided for the same reason. In this stage, the n-type polycrystalline Si 40 serves as a driver, the p-type polycrystalline Si TFT 41 serves as a load, while the n-type polycrystalline Si 42 serves as a device for cascode connection. In the final stage, a source follower stage is provided for reducing output impedance. The N-type polycrystalline Si TFT 44 and the N-type polycrystalline Si TFT 45 serve as a driver and a load, respectively. Selector switches 55 and 56 are provided for the gates of the driver TFT 44 and the load TFT 45, respectively. Both of the switches have functions that are the same as the function of the offset canceling buffer outputting switch 16. While the selector switches 55 and 56 are turned off, the differential amplifiers 26 drive the signal lines 7 at low output impedances. While the selector switches 55 and 56 are turned on, the output of the differential amplifier 26 becomes substantially open, so that the differential amplifier 26 has the same effect when the offset canceling buffer outputting switch 16 is turned off. The driving voltages and the threshold voltages of the n-type polycrystalline Si TFTs 44 and 45 are set such that they are turned off when the selector switches 55 and 56 are turned on.

According to the third embodiment, in order to charge the signal lines 7 within a predetermined period of time, the offset canceling buffer outputting switches 16 need to have a comparatively large gate width so as to make their on-resistances to be sufficiently small. However, according to this embodiment, it is possible to design the selector switches 55 and 56 to have comparatively large on-resistances, so that it is possible to design the areas of the differential amplifiers to be small.

Fifth Embodiment

Figure 10:
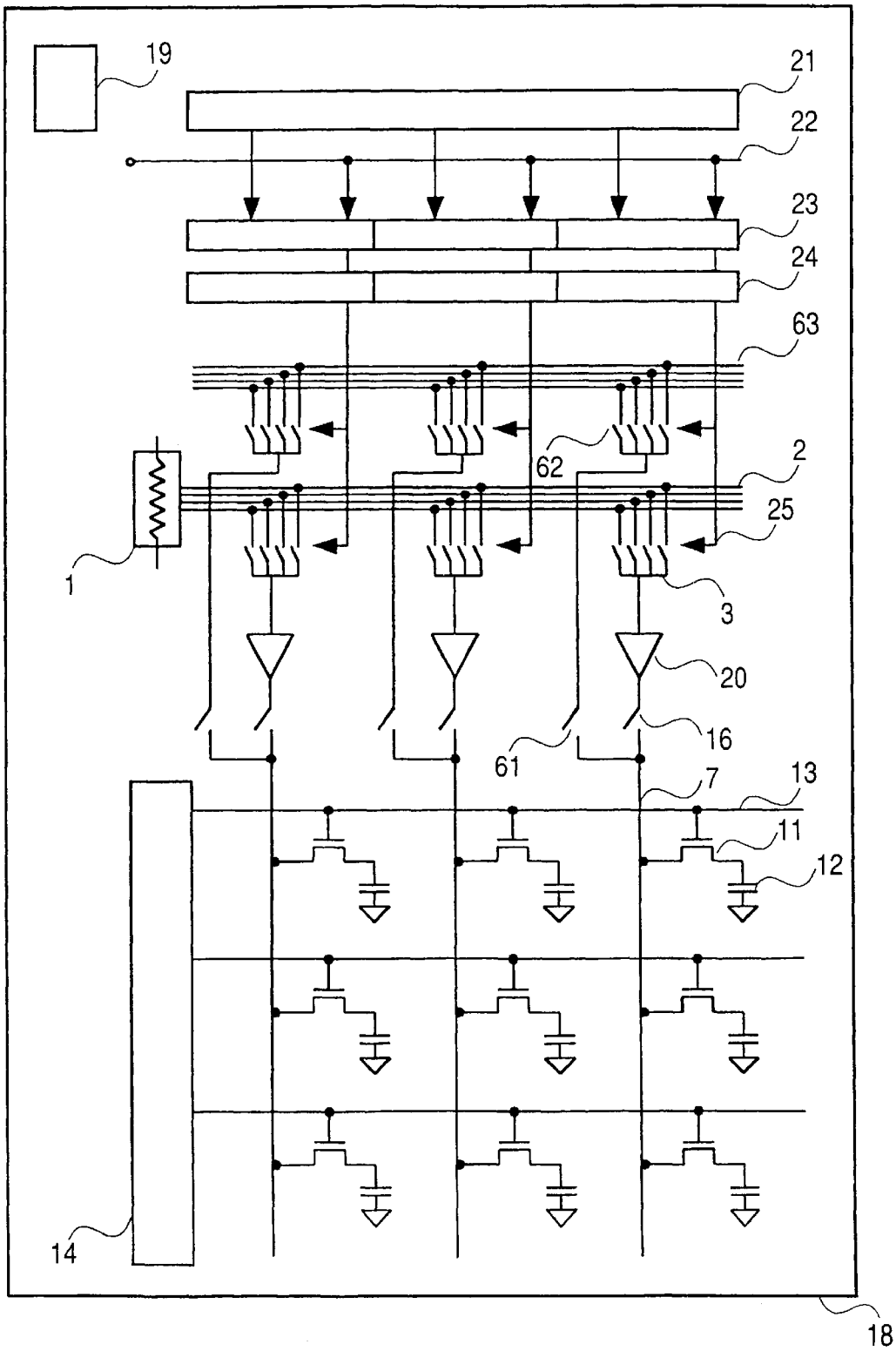
FIG. 10 is a diagram showing a polycrystalline liquid crystal display panel according to a fifth embodiment.

A polycrystalline Si liquid crystal display panel according to a fifth embodiment of the present invention will be described with reference to a diagram of FIG. 10. The structure and the basic operation of the panel are the same as those according to the first embodiment, described before, except that signal line shunting switches 61 are connected to shunt lines 63 through shunt line selection switches 62. The shunt line selection switches 62 are controlled by the level select lines 25 in the same manner as the level select switches 3. As illustrated, the shunt lines 63 cross over the almost entire glass substrate 18, so that they become longer than the width of the image display area that comprises display pixels.

This embodiment is characterized in that the shunt lines 63 are provided for mutually shunting the signal lines 7 to eliminate variations in the offset voltages of the outputs of the offset canceling buffers 20. In other words, in this embodiment, in the second half period of outputting analog image signal voltage outputs to the signal lines 7, short-circuiting between the signal lines 7 to which image signal voltages based on the identical image display data are supplied is performed by the shunt line selection switches 62 and the shunt lines 63 rather than the level select switches 3 and the gradation power lines 2 according to the first embodiment.

In this embodiment, by providing the shunt lines 63 for shunting only in this manner, the influence of turning off the signal line shunting switches 61 might not be exerted upon the offset canceling buffers 20, so that design allowances can be increased.

Variations in the offset voltages turns into a problem especially when intermediate gradation levels are displayed by means of liquid crystals. Thus, it is also possible to reduce the number of the shunt line 63 to the number corresponding to the number of the intermediate gradation levels, thereby reducing the layout area. In this embodiment, for example, while the number of the gradation power lines 2 is 64×2 for reverse-voltage driving, the number of the shunt lines 63 is 32×2 for reverse-voltage driving.

Sixth Embodiment

Figure 11:
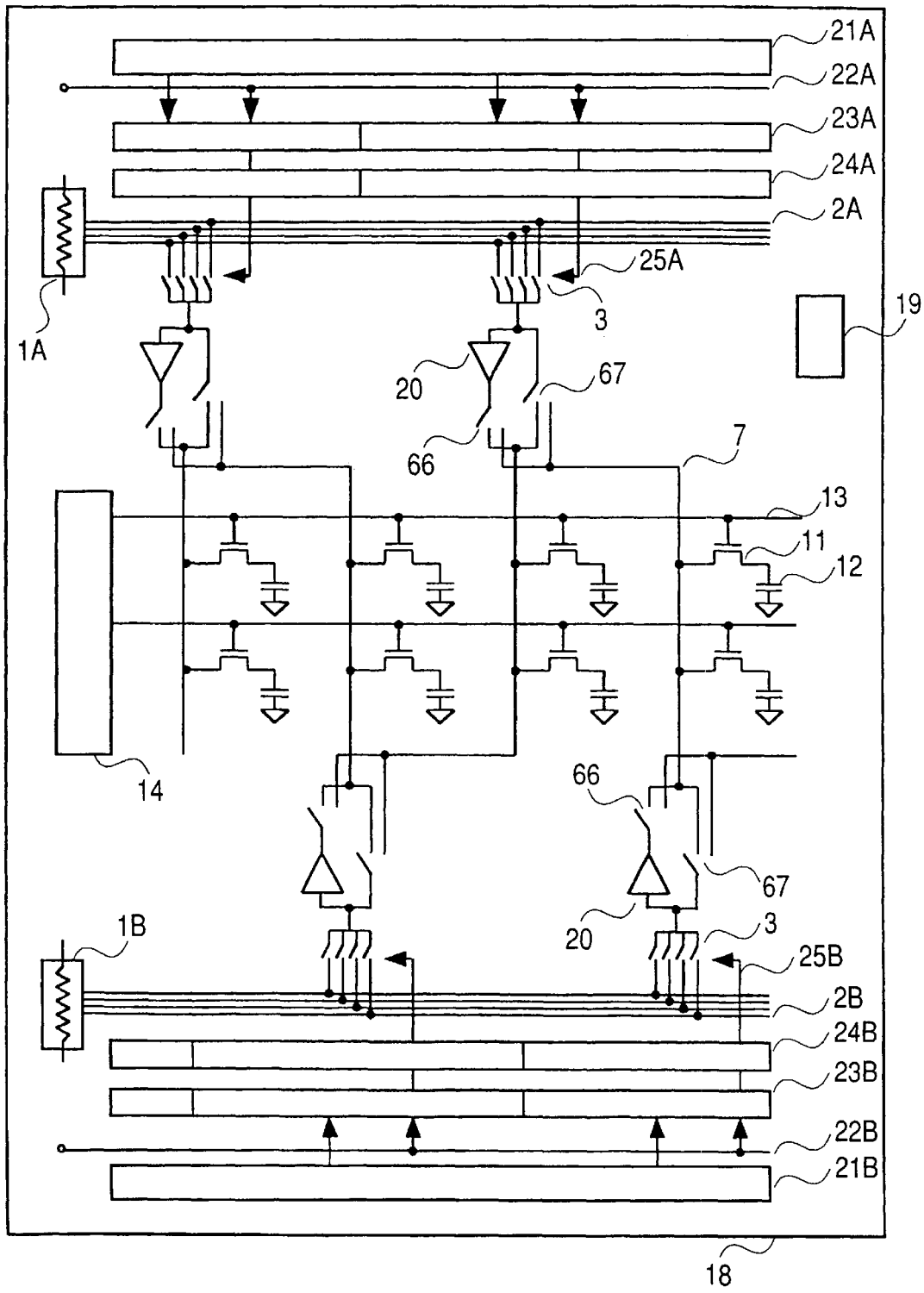
FIG. 11 is a diagram showing a polycrystalline Si liquid crystal display panel according to a sixth embodiment.

A polycrystalline Si liquid crystal display panel according to a sixth embodiment of the present invention will be described with reference to a diagram in FIG. 11. The structure and the basic operation of the panel are the same as those according to the first embodiment described before with reference to FIG. 1, except that write circuits to the signal lines 7 are provided above and below the signal lines 7 and two signal lines connected to an offset canceling buffer outputting switch 66 and a signal line shunting switch 67 are present. Structural elements corresponding to those in FIG. 1 in the upper write circuit and the lower write circuit are indicated by like reference numerals to which A and B are added, respectively.

When driving liquid crystals, writing of image signal voltages to the signal lines 7 is performed by inverting the polarity of the voltages for each field. In this embodiment, by alternately performing switching of connection of the signal lines 7 to the offset canceling buffer outputting switches 66 and the signal line shunting switches 67 for each field, odd-number rows and even-number rows of the signal lines 7 are alternately for each field connected to the upper write circuit or the lower write circuit. Positive voltages are written from the upper write circuit while reverse voltages are written from the lower circuit.

In this embodiment, by providing the upper and lower write circuits, the layout pitch of the offset canceling buffers 20 can be made to be twice as large as that in the first embodiment. This is advantageous for obtaining high resolution.

Seventh Embodiment

Figure 12:
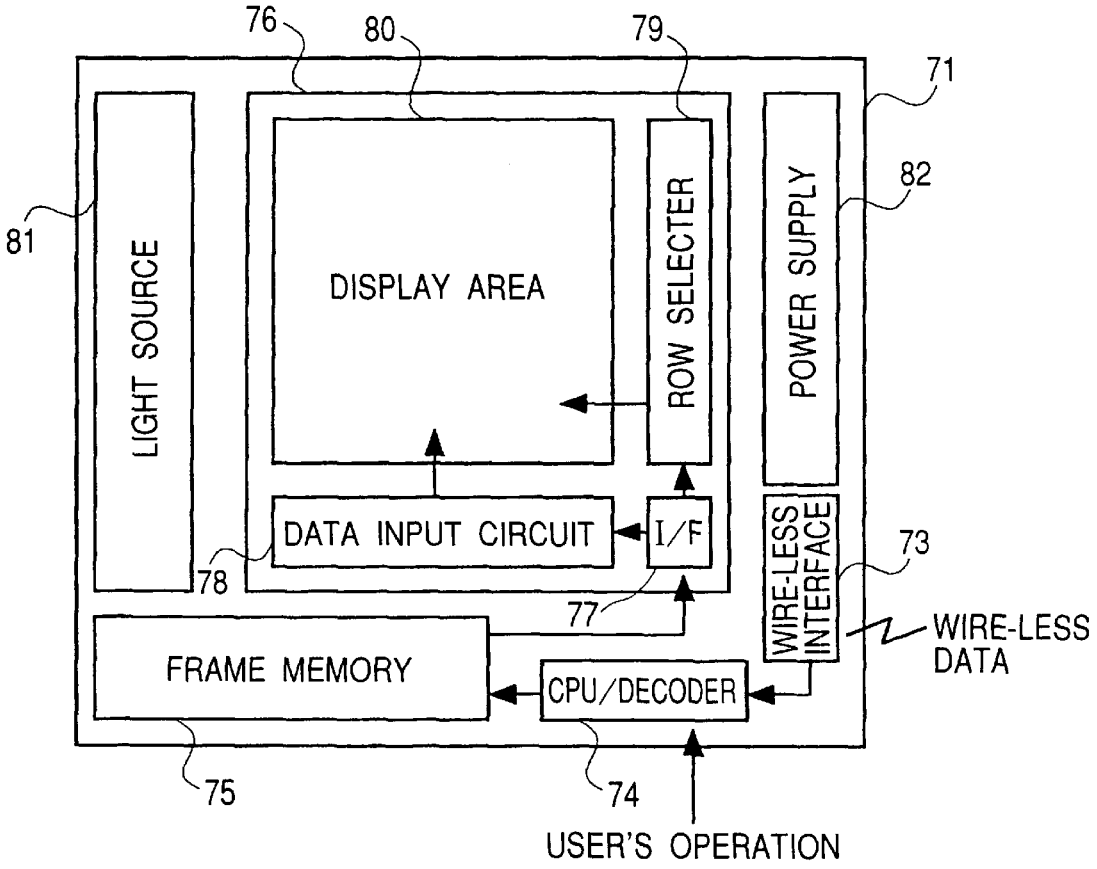
FIG. 12 is a block diagram showing an image viewer 71 according to a seventh embodiment.
Figure 13:
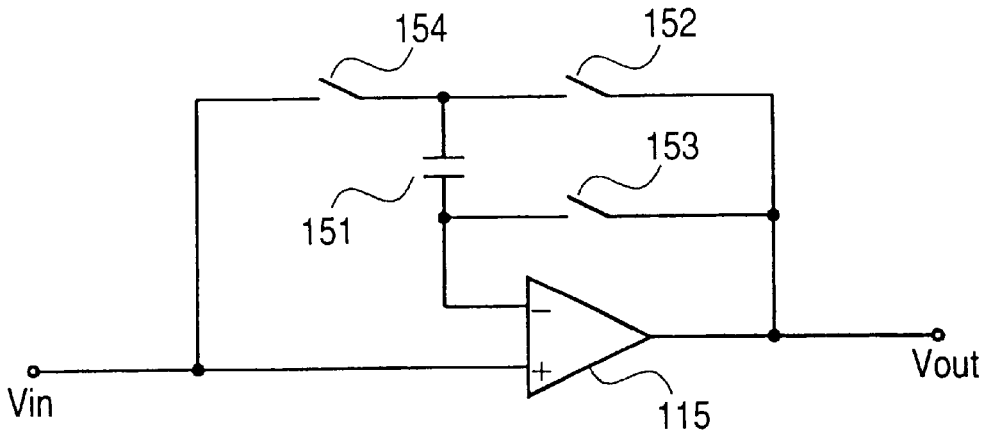
FIG. 13 is a block diagram showing an offset canceling buffer in a conventional polycrystalline liquid crystal display panel.
Figure 14:
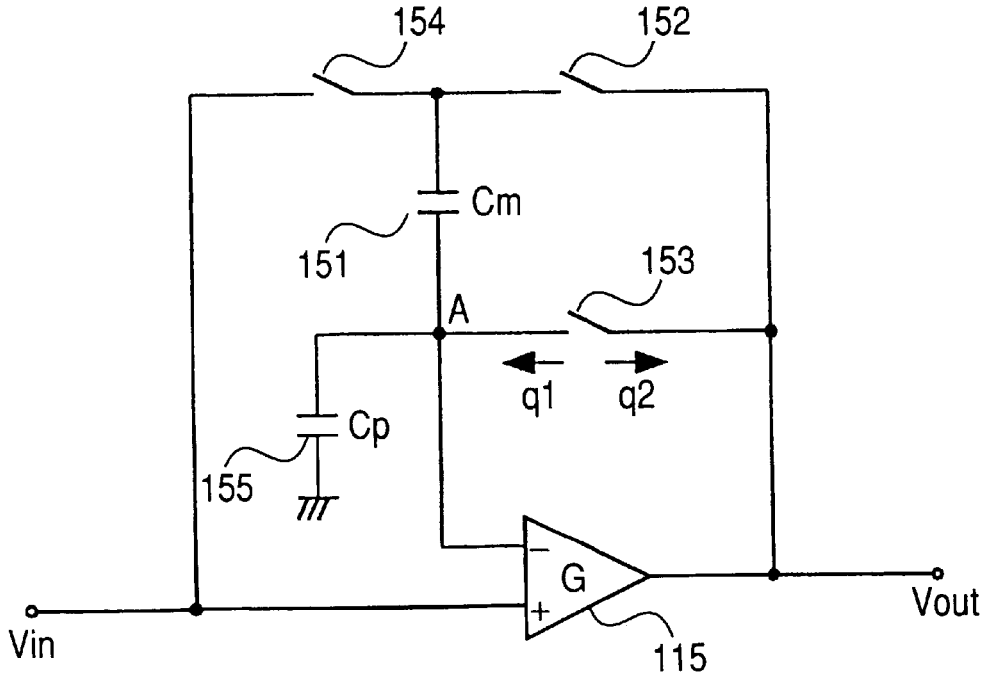
FIG. 14 is a block diagram showing an offset canceling buffer in the conventional polycrystalline liquid crystal display panel.

An image viewer 71 according to a seventh embodiment of the present invention will be described with reference to a diagram in FIG. 12. Compressed image data is externally supplied to a wireless interface (I/F) circuit 73 in the form of wireless data. The output of the wireless I/F circuit 73 is supplied to a frame memory 75 through a central processing unit (CPU)/decoder 74. Then, the output of the frame memory 75 is connected to a row selector circuit 79 and a data input circuit 78 through an interface (I/F) circuit 77. An image display area 80 is driven by the row selector circuit 79 and the data input circuit 78. A power supply 82 and a light source 81 are further provided for the image viewer 71. Incidentally, the configuration and the operation of the polycrystalline Si liquid crystal display panel 76 are the same as those according to the first embodiment.

Next, the operation of this embodiment will be described. The wireless I/F circuit 73 externally receives the compressed image data, and then transfers this data to the CPU/decoder 74. The CPU/decoder 74 drives the image viewer 71 as necessary in response to an operation from a user, or decodes the compressed image data. The decoded image data is temporarily stored in the frame memory 75, which supplies image data for displaying a stored image and a timing pulse to the I/F circuit 77 according to a command from the CPU/decoder 74. As described in the first embodiment, the I/F circuit 77 uses these signals to drive the row selector circuit 79 and the data input circuit 78 to display the image on the image display area. The light source is backlight for liquid crystal display. A secondary battery is contained in the power supply 82 to supply power for driving these devices.

According to the present invention, based on compressed image data, a high quality image free of luminance nonuniformity resulting from offset voltages of respective buffers can be displayed.

What is claimed is:

1. An image display comprising:

liquid crystal capacitances, and a plurality of display pixels being arranged in a matrix and having pixel switches connected to one electrode of the liquid crystal capacitances;

image signal voltage generating means for generating first analog image signal voltages based on image display data;

a plurality of impedance reducing means receiving the first analog image signal voltages and then outputting second analog image signal voltages, being configured by polycrystalline Si thin-film transistors and having differential amplifiers;

a plurality of signal lines connected to output terminals of the impedance reducing means and the pixel switches;

signal voltage write means for writing the second analog image signal voltages in predetermined liquid crystal capacitances through the signal lines and the pixel switches;

first switching means for switching the impedance reducing means to substantially infinite output impedance at a first timing; and second switching means for interconnecting signal lines to which the second analog image signal voltages based on mutually identical said image display data are supplied, at a second timing following the first timing.

2. The image display according to claim 1, wherein the impedance reducing means are differential amplifiers having negative feedback loops.

3. The image display according to claim 2, wherein the differential amplifiers have a cascode structure.

4. The image display according to claim 1, wherein the impedance reducing means include offset canceling circuits for canceling offset voltages between inputs and outputs of the differential amplifiers.

5. The image display according to claim 4, wherein the offset canceling circuits store the offset voltages in capacitances and then insert the capacitances into negative feedback loops of the differential amplifiers.

6. The image display according to claim 4, wherein the offset canceling circuits store the offset voltages in capacitances and then insert the capacitances in series with input terminals of the impedance reducing means to apply the offset voltages of an opposite polarity to positive input terminals of the differential amplifiers.

7. The image display according to claim 1, wherein the image signal voltage generating means comprise a plurality of gradation power lines to which gradation voltages are applied and selector circuits for selecting predetermined ones of the gradation power lines according to the image display data.

8. The image display according to claim 7, wherein the gradation power lines have a length longer than a width of an image display area that comprises the plurality of display pixels arranged in the matrix in a length direction of the gradation power lines.

9. The image display according to claim 7, wherein the second switching means are switches for short-circuiting input terminals and the output terminals of the impedance reducing means.

10. The image display according to claim 1, wherein the second switching means include a plurality of shunt lines for interconnecting the signal lines and selector circuits for selecting predetermined ones of the shunt lines based on the image display data.

11. The image display according to claim 10, wherein the shunt lines have a length longer than a width of an image display area that comprises the plurality of display pixels arranged in the matrix in a length direction of the shunt lines.

12. The image display according to claim 10, wherein a number of the shunt lines is smaller than a number of types of the image display data and the selector circuits are driven upon reception of predetermined image display data.

13. The image display according to claim 1, wherein the first switching means are first transfer switches configured using polycrystalline Si thin-film transistor devices and are provided between outputs of the impedance reduction means and the signal lines.

14. The image display according to claim 13, wherein the second switching means comprise second transfer switches configured using the polycrystalline Si thin-film transistor devices.

15. The image display according to claim 14, wherein at least one of the first and second transfer switches are CMOS structures.

16. The image display according to claim 14, wherein on-resistances of the first transfer switches are smaller than on-resistances of the second transfer switches.

17. The image display according to claim 16, wherein channel widths of the first transfer switches are larger than channel widths of the second transfer switches.

18. The image display according to claim 16, wherein channel widths of the first transfer switches are shorter than channel widths of the second transfer switches.

19. The image display according to claim 14, wherein the first and second transfer switches can perform selection between three states of outputs of the impedance reducing means where the outputs are connected to signal lines in odd-numbered rows for the plurality of display pixels arranged in the matrix, the outputs are connected to signal lines in even-numbered rows for the plurality of display pixels arranged in the matrix, and the outputs are blocked.

20. The image display according to claim 1, wherein at least the pixel switches and the impedance reducing means are formed on an identical insulation substrate, using polycrystalline Si thin-film transistor devices.

21. The image display according to claim 1, wherein the impedance reducing means are alternately aligned in rows on an upper side and a lower side of a display pixel area that comprises the plurality of display pixels arranged in the matrix.

22. The image display according to claim 1, wherein the image display data to be input are compressed, and after the compressed data are expanded to reproduce the image display data, image display based on the input image display data is performed on a display pixel area that comprises the plurality of display pixels arranged in the matrix.

* * * * *